United States Patent [19]

Austin

[11] Patent Number: 4,880,365

[45] Date of Patent: Nov. 14, 1989

[54] CEMENT PUMP WITH REMOVABLE DISCHARGE CHAMBER CARTRIDGE

[76] Inventor: Richard D. Austin, 18414 Buckthorne Rd., Devore, Calif. 92407

[21] Appl. No.: 152,042

[22] Filed: Feb. 4, 1988

[51] Int. Cl.[4] ..... F04B 15/02; F04B 21/02

[52] U.S. Cl. ..... 417/531; 417/539; 417/900

[58] Field of Search ..... 417/454, 531, 539, 900, 417/516, 529

[56] References Cited

U.S. PATENT DOCUMENTS

| | | | |
|---|---|---|---|
| 1,991,342 | 2/1935 | Ball | 417/531 |
| 3,639,086 | 2/1972 | Robbins | 417/539 X |
| 3,647,325 | 3/1972 | Johnson | 417/454 X |
| 3,811,802 | 5/1974 | Semple | 417/454 |
| 3,951,572 | 4/1976 | Ray, Jr. et al. | 417/900 X |
| 3,994,631 | 11/1976 | Hostetter | 417/506 |
| 4,067,666 | 1/1978 | Richards | 417/900 X |
| 4,174,928 | 11/1979 | Austin | 417/397 |
| 4,437,817 | 3/1984 | Wetzelder | 417/900 X |
| 4,634,352 | 1/1987 | Austin | 417/900 X |

*Primary Examiner*—Carlton R. Croyle
*Assistant Examiner*—Leonard P. Walnoha
*Attorney, Agent, or Firm*—Brown, Martin, Haller & McClain

[57] ABSTRACT

A double acting concrete pump includes a pair of pump cylinders with a piston slidable back and forth in each cylinder, the pistons being driven in opposite directions, a connecting manifold connecting each of the cylinder outlets to a source of cement via separate pumping chambers, and a separate, removable discharge manifold for connecting the pumping chamber outlets to a delivery outlet. The discharge manifold has a discharge chamber with a pair of inlets connected to the respective pumping chamber outlets, and a single discharge outlet, with an outlet control valve in the discharge chamber for alternately isolating the flow from each of the pumping chambers to the discharge outlet in response to the pumping action.

4 Claims, 2 Drawing Sheets

CEMENT PUMP WITH REMOVABLE DISCHARGE CHAMBER CARTRIDGE

BACKGROUND OF THE INVENTION

The present invention relates generally to cement pumps, and more specifically to double acting cement pumps employing a pair of power driven, oppositely reciprocating pistons sliding in a pair of cylinders for the pumping action.

Reciprocating cement or concrete pumps are described in my U.S. Pat. Nos. 4,174,928 and 4,634,352. In U.S. Pat. No. 4,634,352, a cement pump of this type is described in which each cylinder outlet is connected to a respective pump response chamber having a valve controlled inlet for connection to a supply of cement or the like. The pump chamber outlets are each connected to a discharge chamber for controlling their connection to a delivery outlet, and a ball valve in the discharge chamber moves between the discharge chamber inlets to alternately isolate the flow of material from the two pump chambers in response to the pumping action.

The cement pump in my previous patents referred to above was of generally unitary construction. It is not easy to clear any clogged material from such an arrangement, and the ball valve seats in the discharge chamber will become worn relatively quickly, resulting in insufficient isolation of the pump chambers and inefficient pumping operation. Thus the entire pump must be replaced fairly often. Also, different jobs may require the use of pre-mixes having different water content, and therefore different viscosity. U.S. Pat. No. 4,634,352 described a pump in which the inlet valves could be readily adjusted for different viscosity materials. However, no adjustment of discharge or outlet valve was provided in this pump.

SUMMARY OF THE INVENTION

It is an object of the present invention to provide an improved cement pump.

According to the present invention a cement or concrete pump is provided which comprises first and second pump cylinders each containing a piston for reciprocating movement back and forth in the cylinder, a pump drive linked to the pistons for simultaneously sliding the pistons back and forth in opposite directions in the respective cylinders, a connecting manifold for connecting the respective cylinder outlets to a supply of flowable material to be pumped, the connecting manifold including first and second pumping chambers each having an inlet for connection to a respective one of the cylinder outlets, a feed inlet for connection to a supply of flowable material, and a discharge outlet for flow of pumped material out of the chamber, and a separate discharge manifold unit releasably securable to the connecting manifold for selectively connecting each of the pumping chamber outlets to a delivery outlet, the discharge manifold unit having a discharge chamber, and a control device for selectively connecting each of the pumping chamber outlets to the discharge chamber while isolating the other pumping chamber from the discharge chamber in response to pumping action of the respective pistons.

The discharge manifold unit is releasably securable to the remainder of the pump by any suitable securing device, for example it may be bolted to the connecting manifold. The outlet end of the connecting manifold and the discharge manifold unit preferably have cooperable mating formations for guided engagement of the discharge manifold unit with the connecting manifold. The discharge manifold unit or cartridge has a pair of inlet openings communicating with the discharge chamber and positioned for alignment with the respective pumping chamber outlets when the unit is secured to the connecting manifold.

The control device preferably comprises a ball valve located in the discharge chamber and moveable between valve seats at the respective inlet openings in response to the pumping action. The valve seats preferably comprise separate valve plate members designed to be sandwiched between opposing surfaces of the connecting manifold and discharge manifold when these two units are secured together. The members each have a projecting boss with a valve seat at its outer end designed to project through the respective inlet openings into the discharge chamber. Thus the valve seats can be replaced quickly and easily when worn or damaged.

Thus, by providing a separate discharge manifold unit or cartridge with releasably mounted valve seats on the double acting cement or concrete pump, the valve seats can be replaced when worn. Previously, the valve seats were generally not accessible and could not be replaced or repaired, so that the entire pump would have to be replaced when these parts became worn. The removable manifold also allows easy access to other adjacent parts of the pump in the case of any blockages or jams of the flowable material being pumped. Cement and other such water mixture materials tend to clog any device with which they come into contact, and if permitted to set can render the pump inoperative. The removable discharge manifold can be separated from the connecting manifold quickly and easily in the event of any clogging, allowing access to both the discharge chamber and the pumping chambers to clean out any clogged material.

Preferably, a number of different size valve balls will be provided for selective use in the discharge chamber with mixtures having different viscosities. The discharge manifold unit can be assembled on site with the selected valve ball size once the material characteristics have been determined. This will control the flow of material through the discharge chamber. Alternatively, valve seats having different bore sizes may be provided for use with materials having different flow characteristics. Thus the discharge chamber can be readily adjusted to accommodate different flow materials. Rather than having to provide several different pumps for different flow materials, the same basic pump can be used with the discharge chamber unit or cartridge being adjusted for materials having differing flow characteristics.

The pump of this invention is therefore easily adjusted, cleaned and maintained by the provision of a discharge manifold as a completely separate cartridge from the remainder of the pump.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
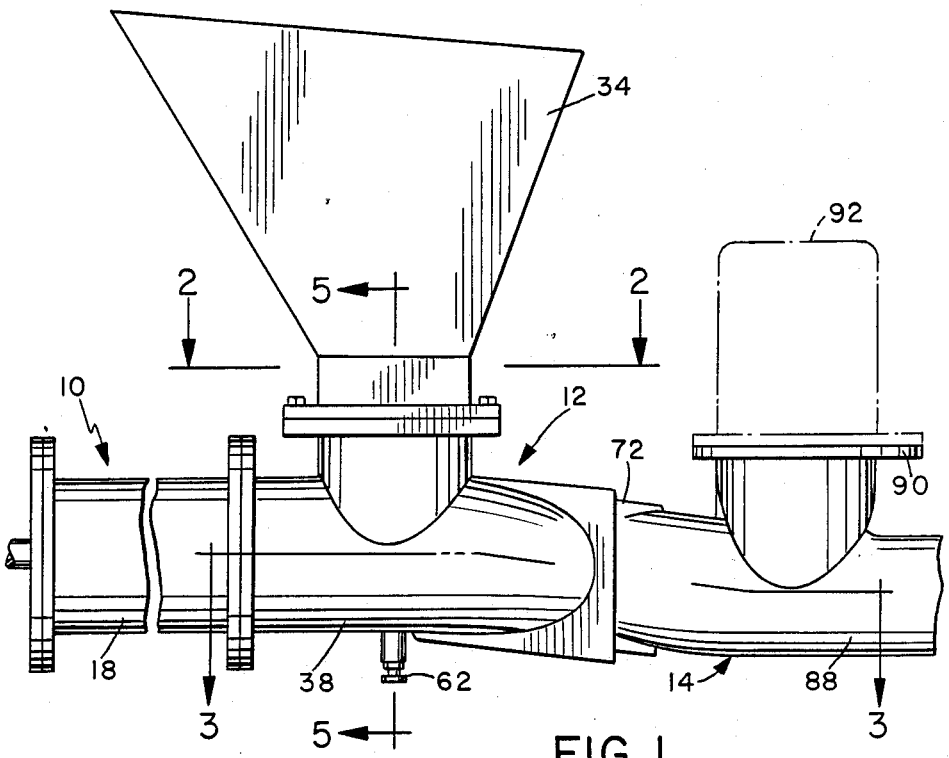
FIG. 1 is a side elevation view of the cement pump structure according to a preferred embodiment of the present invention.
Figure 2:
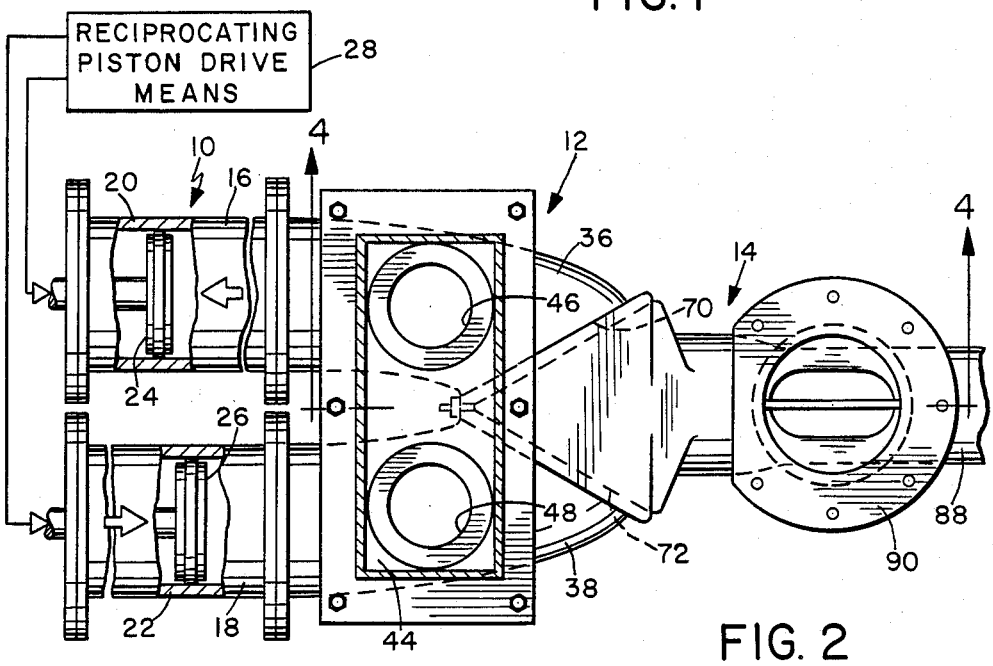
FIG. 2 is a sectional view taken on line 2—2 of FIG. 1.

The drawings show a double acting pump for pumping premixed cement or concrete, or other similar flowable materials of mud-like viscosity, according to a preferred embodiment of the present invention. As seen in FIGS. 1 and 2, the pump is basically formed in three parts, consisting of a pumping section 10, a connecting manifold 12, and a discharge manifold or cartridge 14. The pumping section 10 is similar to that shown in my U.S. Pat. No. 4,634,352 referred to above and consists of a pair of reciprocating piston pumps 16,18 comprising pump cylinders 20,22 arranged horizontally in spaced parallel relationship, and a pair of pistons 24,26 which move with a reciprocating motion in the respective cylinders. The pistons are driven in opposite directions by a suitable drive assembly indicated schematically at 28. Cylinders 20,22 have outlets 30,32 (see FIG. 3),respectively at one end for connecting the pumps to a supply of fluid to be pumped and for discharging pumped fluid out of the cylinders.

Figure 5:
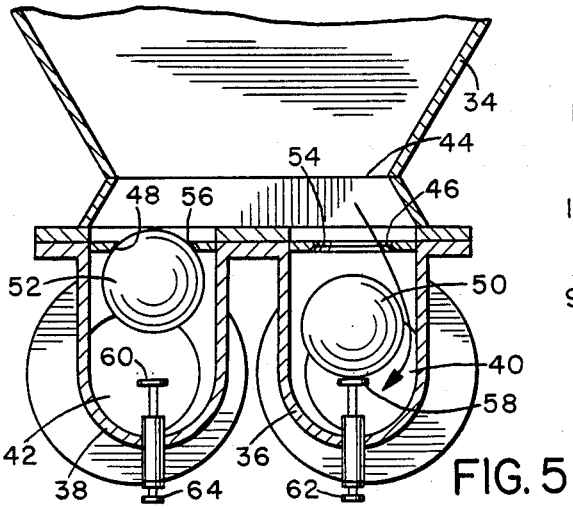
FIG. 5 is a sectional view taken on line 5—5 of FIG. 1.

Connecting manifold 12 connects the pump outlets to a supply of flowable material to be pumped via supply hopper 34. As in my previous U.S. Pat. No. 4,634,352 referred to above, the connecting manifold has two arms 36,38 connected to the respective pump outlets, with a respective pump response chamber 40,42 within each arm. Hopper 34 has a single rectangular outlet connection 44 which is connected to material inlets 46, 48 to the respective pump chambers 40 and 42, as best seen in FIGS. 2 and 5.

The flow of pre-mixed cement from the hopper to the cylinders 20 and 22 through the separate pump response chambers 40 and 42, respectively, is governed by the position of ball valves 50 and 52 within the respective chambers 40 and 42. The valves 50 and 52 are best seen in FIG. 5 and are moveable vertically between valve seats 54,56 at the respective inlets 46 and 48 and stops 58,60 which are adjustably mounted in the base of the respective chambers. The vertical position of the stops is adjustable by means of external adjustment knobs 62,64. Each pump response chamber 40,42 has a material flow outlet 66,68 for connection with the discharge manifold 14 as explained below.

Figure 3:
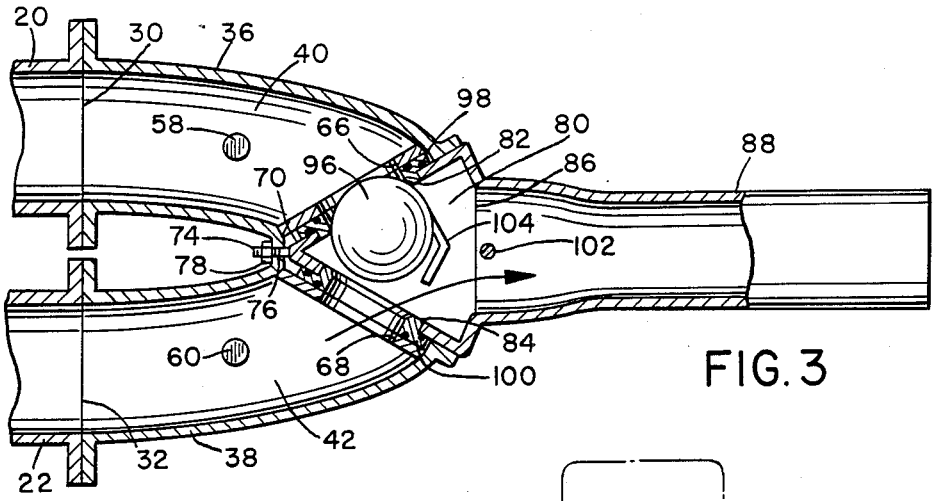
FIG. 3 is a sectional view taken on line 3—3 of FIG. 1.
Figure 4:
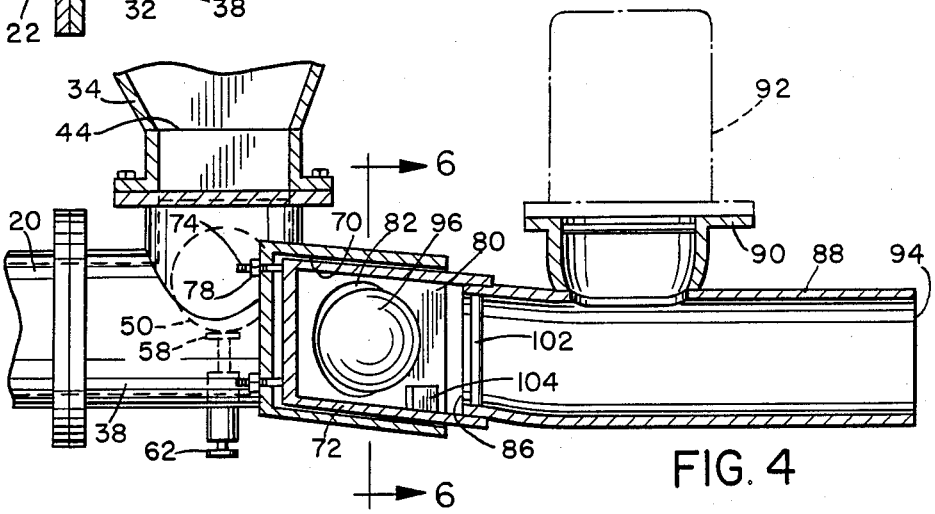
FIG. 4 is a sectional view taken on line 4—4 of FIG. 2.

The discharge manifold is in the form of a separate, butterfly wedge cartridge for releasable mating or wedging engagement with the outlet end of the connecting manifold. Preferably, as shown in FIGS. 2,3 and 4, the outlet end of the connecting manifold has a generally V- or wedge-like indent 70, and the inlet end of the discharge manifold is of corresponding V or wedge-like shape 72. Bolt-like threaded projections or pins 74 at the pointed end of manifold 14 extend through corresponding openings 76 in the wall of the connecting manifold and are secured by means of nuts 78 to lock the discharge manifold in position. Although cooperating V-shaped mating formations are provided on the connecting and discharge manifolds in the preferred embodiment shown in the drawings, other suitable cooperating formations may be used in alternative embodiments for mating engagement between the units.

The connecting manifold has a discharge chamber 80 at its V-shaped end with inlets 82,84 to the chamber 80 in the respective opposite faces of the wedge or V-shape for communication with corresponding outlets 66,68 from the respective pump response chambers, as illustrated in FIG. 3. The discharge chamber 80 has a single discharge outlet 86 connected to discharge outlet pipe 88 at the opposite end of the cartridge. The pipe 88 has a surge chamber connector 90 for connection to a surge chamber 92 for smoothing the output flow, and an outlet or supply opening 94 for connection to a flexible hose or the like for applying the cement in a standard fashion.

A discharge chamber isolation ball valve 96 within the discharge chamber is free to move generally horizontally within the chamber in response to material flow between annular valve seat members 98,100 at the respective inlets. A vertical stop or pin 102 is positioned at the discharge chamber outlet 86, as shown in FIGS. 3 and 4, to prevent loss of the valve ball 96 into the discharge pipe 88. Preferably, a boss 104 is provided in the base of chamber 80 to prevent the ball 96 from falling too low in the chamber and to keep it aligned with the valve seats.

Figure 6:
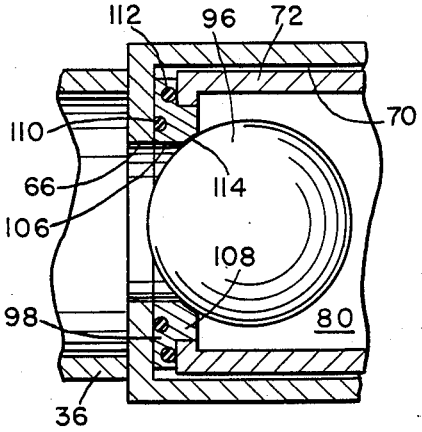
FIG. 6 is an enlarged sectional view taken on line 6—6 of FIG. 4.

Valve seat members 98,100 are preferably formed separately from the discharge manifold and comprise annular plates each having a through bore 106 and a projecting boss 108 which projects through the respective inlet opening into chamber 80, as shown in FIGS. 3 and 6. The valve seat members are sandwiched or gripped between the opposing faces of the wedge-shaped co-operating formations on the connecting manifold and discharge manifold, when the two units are secured together, as shown in FIGS. 3 and 6. Annular O-ring seals 110,112 are mounted on opposite faces of each of the valve seat members for sealing engagement with the respective opposed face of the connecting and discharge manifold, respectively. The inlet end of each boss is provided with a generally spherical annular valve seat 114 for seating the valve ball as shown in FIG. 6.

The operation of the cement pump is essentially the same as described in my previous U.S. Pat. No. 4,634,352 referred to above. Valve stops 58,60 will first be set for the viscosity of the material to be pumped, with the valve opening determined by the position of the respective stop. Thus the opening will be made larger for higher viscosity materials. With the separate discharge manifold of this invention, valve ball 96 can also be adjusted for different viscosity materials. For example, different size valve balls may be provided for controlling the flow of different viscosity materials, and valve seat members with different diameter bores 106 may also be provided.

When the desired adjustments have been made, the discharge manifold or wedge cartridge will be connected to the connecting manifold outlet, with the valve seat members in position between the two units. The drive assembly 28 can then be activated. The drawings illustrate a condition of the pump in which the piston 26 of pump 18 is undergoing a discharge stroke while the piston 24 of pump 16 is undergoing a suction stroke. The suction created in cylinder 20, and thus in chamber 40, causes the valve ball 50 to be drawn away from valve seat 54, allowing cement to be withdrawn from the hopper, through the pump response chamber 40, and into cylinder 20. At the same time, cement flow out of cylinder 22 into pump response chamber 42 forces valve ball 52 against valve seat 56 to close the material inlet. The pressurized cement then flows through outlet 68, valve seat member 100, and into the discharge chamber 80, forcing valve ball 96 against the opposite valve seat of member 98, to isolate the other pump response chamber from the discharge manifold. Pressurized cement is then supplied along discharge pipe 88 to a suitable supply hose or the like. When the pistons 24,26 reverse on the next stroke of the pump, the opposite effect occurs, with valve ball 52 moving away from valve seat 56 while valve ball 50 closes, and valve ball 96 moving across to the opposite valve seat member 100.

In the event of any blockage, the discharge unit or cartridge can be removed to allow access to both the pump response chambers and the discharge chamber for cleaning. Another advantage is that the valve seat members can be replaced when the seats become too worn to provide an effective seal. The ball valve 96 is relatively heavy and is forced against the valve seats repeatedly under considerable pressure, leading to the seats becoming worn relatively quickly, resulting in an inefficient pumping operation. In the past this has involved replacement of the entire pump assembly fairly frequently, for example as often as every 6 months. With this invention the valve seat members can be replaced quickly and easily, considerably increasing the effective lifetime of a pump installation.

Thus the cement pump described above with a separable discharge manifold or wedge cartridge allows access to the various chambers for washing out of the assembly in the event of jams or blockages. Also, the valve openings of the discharge chamber can be adjusted quickly and easily for different viscosity materials, for example by providing a series of different size ball valves for use in the chamber. Alternatively, or additionally, valve seat members having different diameter through bores may be provided. The valve seat members can be removed and replaced quickly and easily when worn, increasing the lifetime of the pump.

Although a preferred embodiment of the invention has been described above by way of example only, it will be understood by those skilled in the field that modifications may be made to the disclosed embodiment without departing from the scope of the invention, which is defined by the appended claims.

I claim:

1. A double acting concrete pump, comprising:

first and second pump cylinders with a respective piston slidable back and forth in each of the cylinders, the cylinders having outlets at one end for receiving and discharging fluid to be pumped;

drive means operatively connected to the pistons for simultaneously driving them in opposite directions to reciprocate back and forth in their respective cylinders;

a connecting manifold for selectively connecting the outlet of each cylinder to a supply of fluid to be pumped, the manifold having first and second pumping chambers in flow communication with the first and second cylinder outlets, respectively, each pump chamber having an inlet for connection to a supply of fluid to be pumped and a discharge outlet for flow of pumped material out of the chamber;

the connecting manifold having a generally wedge-shaped indent at its outer end, having opposite side walls forming a V-shape and upper and lower walls, the respective pump chamber outlets being located in opposite side faces of said indent;

a discharge manifold of corresponding wedge shape to said indent for connecting each of the pump chamber outlets to a delivery outlet, the discharge manifold having a discharge chamber, and a pair of inlets for alternately connecting the discharge outlet of each pump chamber to the discharge chamber while isolating the other pump chamber in response to pumping action of the respective pistons, the discharge manifold being formed as a unit separable from the remainder of the pump; said discharge chamber inlets being located in respective opposite side faces of said wedge-shaped discharge manifold and being positioned for alignment with the respective pump chamber outlets when the discharge manifold is secured in the indent;

and releasable securing means for releasably securing the discharge manifold unit to the connecting manifold with the pump chamber outlets in communication with the discharge chamber;

the connecting manifold indent comprising means for mating engagement with said discharge manifold with said respective pump chamber outlets aligned with the respective discharge chamber inlets.

2. The pump as claimed in claim 1, wherein said control means comprises outlet valve means within said discharge chamber moveable between first and second positions blocking said first and second inlets, respectively, in response to pumping action of the respective pistons.

3. The pump as claimed in claim 1, including first and second releasable valve seat members for engagement with said first and second discharge chamber inlets, respectively, said outlet valve means being moveable between said first and second valve seat members for alternately isolating flow from the respective pumping chambers, said releasable securing means further comprising means for releasably securing said valve seat members in position.

4. The pump as claimed in claim 3, wherein said valve seat members each comprise a plate having a projecting boss for extending through the respective discharge chamber inlet, the boss having a valve seat for locating the valve means at its outer end, the seat member having a through bore for communication between the respective pumping chamber and the discharge chamber, the connecting manifold and discharge unit having opposing surfaces which engage when the discharge unit is secured in place, each plate being sandwiched between the respective opposing surfaces when the manifolds are secured together.

* * * * *